United States Patent [19]

Korsgaard

[11] Patent Number: 4,843,774

[45] Date of Patent: Jul. 4, 1989

[54] UNDERROOF

[75] Inventor: Vagn Korsgaard, Hørsholm, Denmark

[73] Assignee: V.I.K.-Consult ApS, Hørsholm, Denmark

[21] Appl. No.: 27,236

[22] Filed: Mar. 18, 1987

[30] Foreign Application Priority Data

Mar. 21, 1986 [DK] Denmark ..... 1333/86

[51] Int. Cl.[4] ..... E04B 7/00

[52] U.S. Cl. ..... 52/408; 52/309.1; 52/309.15; 52/407; 52/515

[58] Field of Search ..... 52/309.9, 309.11, 309.14, 52/408, 409, 411, 412, 413, 464, 540, 515, 516, 517, 410, 540, 589, 591, 592, 90, 390.1, 390.15, 407

[56] References Cited

U.S. PATENT DOCUMENTS

| | | | |
|---|---|---|---|
| 2,760,881 | 8/1956 | Toulmin, Jr. | 52/515 |
| 3,122,073 | 2/1964 | Masse | 52/408 |
| 3,149,693 | 9/1964 | Kelley et al. | 52/515 |
| 3,310,917 | 3/1967 | Simon | 52/515 |
| 3,665,667 | 5/1972 | Oberley et al. | 52/408 |
| 3,694,983 | 10/1972 | Couquet | 52/592 |
| 4,244,151 | 1/1981 | Seem | 52/309.9 |
| 4,244,761 | 1/1981 | Remi et al. | 52/408 |

FOREIGN PATENT DOCUMENTS

| | | | |
|---|---|---|---|
| 1922364 | 11/1970 | Fed. Rep. of Germany | 52/540 |
| 2051910 | 1/1981 | United Kingdom | 52/410 |

*Primary Examiner*—Michael Safavi

*Attorney, Agent, or Firm*—Watson, Cole, Grindle & Watson

[57] ABSTRACT

An underroof for a sloping exterior roof and comprising a moisture-absorbing layer which on both sides comprise spaced, substantially horizontal highly diffusion-resistant strips, the diffusion-resistant strips on the top side of the moisture-absorbing layer partly overlapping the diffusion-resistant strips on the underside and being water tightly connected along their upper edges with the diffusion-resistant strips on the underside.

The underroof is impermeable to water flowing along the top surface thereof but has a sufficiently high resistance to diffusion to prevent summer condensation. Furthermore, it is capable of absorbing and discharging condensate formed on its underside.

3 Claims, 1 Drawing Sheet

UNDERROOF

BACKGROUND OF THE INVENTION

The present invention relates to an underroof for a sloping exterior roof and comprising a moisture absorbing layer.

It is well known to provide underroofs below sloping exterior roofs, such as tiled roofs, slate roofs, and roofs made from asbestos or cement slabs. The primary function of such underroofs is to prevent moisture, which penetrates the exterior roof through the inevitable gaps therein during heavy rain fall or the melting of snow drifts, from causing damage to the building. The present underroofs typically consist of reinforced plastic films which are both impermeable to water and have a high diffusion resistance. However, the use of such underroofs presents the problem that during the winter months water vapours tend to be condensed on the underside of the underroof in such amounts that severe damage may occur. In order to prevent such damage it is normally required that the loft be effectively ventilated. However, in practice this is not always possible.

If the loft has been converted into living quarters or if the ceiling located underneath the underroof extends parallel to the roof surface, the space between the underroof and such rooms or ceiling has to be thermally insulated.

In order to prevent the formation of condensate on the underroof it is normally necessary to provide a vapour barrier on the underside of the thermal insulation and to provide between the underroof and the insulation a space of a width of, e.g., 4 cm, which can be vented to the atmosphere.

In practice it has been found difficult to avoid the formation of condensate on the underroof because the vapour barrier on the underside of the insulation normally cannot be made sufficiently air tight to prevent humid air from migrating from the underlying rooms to the roof structure and to form condensate on the underroof.

Since the underroof normally hangs down between the rafters and tends to contact the insulation layer within small or large zones, the required ventilation space between the top side of the insulation and the underroof normally cannot be obtained.

In order to reduce the risk of moisture damage due to the formation of condensate on the underroof, the latter is often made from a material having a certain moisture absorbing capability and a low resistance to diffusion so that the absorbed condensate may diffuse through the underroof to the space between the exterior roof and the underroof, which space normally is effectively vented to the atmosphere. Even in cases where the resistance to diffusion of the underroof is low, the rate at which accumulated condensate diffuses to the underroof is relatively low. This is due to the fact that the thin films from which the underroof typically is made have an insignificant resistance to heat transfer compared to the total resistance to heat transfer exhibited by the roof construction.

In the well ventilated space between the top side of the underroof and the underside of the exterior roof the relative humidity will be the same as in the free air, which is typically close to 100% during the winter months. Since the temperature on the moist underside of the underroof will be equal to the temperature of the top side thereof, there will be no partial pressure difference to force the accumulated condensate through the underroof. Therefore, the condensate will remain in the underroof until, e.g., sunshine on the roof will force it back through the insulation to the vapour barrier on the underside of the insulation at which it will condensate and cause dripping from the ceiling. A low resistance to diffusion may also cause so-called summer condensation. Summer condensation arises when the roof coating has been wetted by rain and has absorbed moisture and the moisture under the influence of sunlight is forced into the underroof and the underlying heat insulation and is condensed on the relatively cold vapour barrier where it may cause moisture damage and lead to dripping from the ceiling.

It is also well known to prepare underroofs of fibrous materials, such underroofs having a top side coated with an essentially water-impermeable asphalt layer. The use of such an underroof may also lead to the formation of condensate on its underside and the condensate thus formed cannot penetrate the asphalt layer on the top surface of the underroof.

An ideal underroof should be impermeable to water flowing along the top side thereof, it should have a sufficiently high resistance to diffusion so that summer condensation is prevented, and it should be capable of absorbing condensate on its underside and allowing the condensate to migrate to its top side, where it should be capable of being evaporated.

If the underroof has these properties, it will not cause the above-mentioned condensation problems and the space between the heat insulation and the underroof can be either eliminated or used for increasing the thickness of the roofing.

SUMMARY OF THE INVENTION

The underroof according to the invention is characterized in that both sides of the moisture-absorbing layer comprise spaced, substantially horizontal highly diffusion resistant zones, the highly diffusion-resistant zones on the top side of the moisture-absorbing layer partly overlapping the diffusion-resistant zones on the underside and being water tightly connected with the diffusion resistant zones on the underside at their upper edges.

The highly diffusion-resistant zones preferably consist of strips of a plastic film which are attached to the moisture-absorbing layer and the invention will be described with reference to a moisture-absorbing layer coated with such strips of plastic film. However, it should be pointed out that the above-mentioned zones can also be provided in a different manner, e.g., by applying dense stripes of paint to the moisture-absorbing layer.

The underroof according to the invention prevents water which is flowing down along the underroof and which is partially absorbed in the moisture-absorbing layer from dripping through the underroof. Furthermore, it allows condensate which is formed on the underside of the underroof to be absorbed in the moisture-absorbing layer from which it can migrate to the exterior free zones of the moisture-absorbing layer and evaporate. Thus, the above-mentioned moisture damage which may occur during the winter months is eliminated.

The underroof according to the invention also prevents the above-mentioned summer condensation because the partially overlapping strips and the intermediate moisture-absorbing layer offer such a high total vapour diffusion resistance that moisture cannot be forced through the underroof under the influence of sunlight.

The width of the strips is, e.g., about 7 cm, and the spacing between the strips is preferably about 4 cm. The strips on the top surface of the underroof can be located in such manner that they overlap the strips on the underside by 1–3 cm. Such an overlapping produces a suitable vapour diffusion resistance.

When the strips are composed of a thin plastic film, the latter preferably has a weight of 15–25 g/m$^2$ and preferably consist of polyethylene, polypropylene, or the like.

The moisture-absorbing layer preferably consists of synthetic fibres such as polypropylene fibres or glass fibres and the layer preferably has a thickness corresponding to a weight of 100–200 g/m$^2$.

The water tight connections between the strips on the opposite sides of the moisture-absorbing layer are preferably provided in a well known manner as by welding through the moisture-absorbing layer.

DETAILED DESCRIPTION OF THE PREFERRED EMBODIMENT

Figure 2:
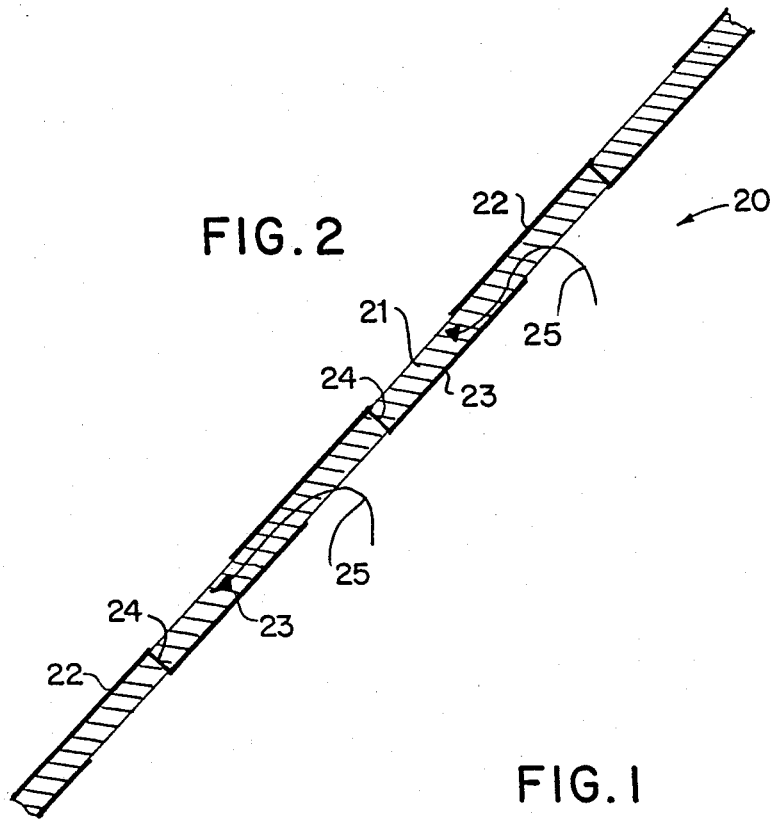
FIG. 2 is an enlarged sectional view of the underroof construction as seen along line 2—2 in FIG. 1.
Figure 1:
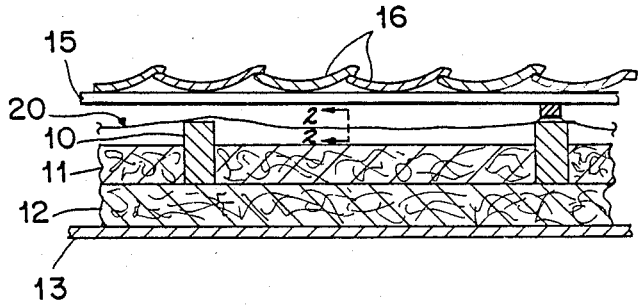
FIG. 1 is a cross-sectional view of a sloping roof assembly which includes an outer roof and the underroof construction according to a preferred embodiment of the present invention.

FIG. 1 shows a sloping roof assembly which includes an underroof according to the present invention, the assembly including spaced roof rafters 10, insulation 11 between the rafters, insulation 12 beneath the rafters, an interior wall 13 secured beneath the insulation 12, the inventive underroof 20 overlying and spanning the roof rafters 10, transverse strips 15 secured over the underroof, and outer roof tiles 16 mounted on the strips 15 so as to be spaced from the underroof 20. The underroof 20 comprises a moisture-absorbing layer 21 consisting of a moisture absorbing layer 15 consisting of synthetic plastic fibres. Both sides of the layer are coated with strips 22,23 of a plastic film. The film strips 22 on the top side of the underroof are at their upper edges connected with the film strips 23 on the underside by means of welding seams 24.

Arrows 25 indicate how the condensate formed on the underside of the underroof moves towards the uncoated zones on the exterior side where it evaporates.

I claim:

1. A sloping roof assembly which comprises a plurality of inclined, spaced-apart rafters, an inclined underroof positioned over said plurality of rafters, and an inclined outer roof positioned in spaced fashion over said underroof, said underroof comprising an inclined moisture-absorbing layer of fibrous synthetic material, said moisture-absorbing layer having a top surface and an under surface, a plurality of spaced-apart first strips of a diffusion-resistant and substantially water-impervious material which are positioned in parallel against the top surface of said moisture-absorbing layer and oriented transversely to said rafters, each said first strip having opposite first and second longitudinal edges, the first longitudinal edge of each said first strip being located upwardly along said inclined moisture-absorbing layer as compared to the second longitudinal edge thereof, a plurality of spaced-apart second strips of a diffusion-resistant and substantially water-impervious material which are positioned in parallel against the under surface of said moisture-absorbing layer and oriented transversely to said rafters, each said second strip having opposite first and second longitudinal edges, the first longitudinal edge of each said second strip being located upwardly along said inclined moisture-absorbing layer as compared to the second longitudinal edge thereof, and connection means of a diffusion-resistant and substantially water vapor-impervious material extending through said moisture-absorbing layer and connecting the first longitudinal edge of each first strip with a second longitudinal edge of an associated second strip, the second longitudinal edge of each first strip extending further downwardly along the inclined moisture-absorbing layer than the first longitudinal edge of a next lower second strip to the second strip to which said first strip is connected by said connection means.

2. A sloping roof assembly according to claim 1, wherein said first and second strips are made of plastic.

3. A sloping roof assembly according to claim 1, wherein said connection means are made of plastic.

* * * * *